US006508665B1

(12) United States Patent
Yeh

(10) Patent No.: US 6,508,665 B1
(45) Date of Patent: Jan. 21, 2003

(54) ELECTRICAL CONNECTOR HAVING PRINTED CIRCUIT BOARD MOUNTED THEREIN

(75) Inventor: Joel J. Yeh, San Gabrie, CA (US)

(73) Assignee: Hon Hai Precision Ind. Co., Ltd., Taipei Hsieh (TW)

( * ) Notice: Subject to any disclaimer, the term of this patent is extended or adjusted under 35 U.S.C. 154(b) by 0 days.

(21) Appl. No.: 10/017,224

(22) Filed: Nov. 29, 2001

(51) Int. Cl.[7] ..... H01R 13/66
(52) U.S. Cl. ..... 439/541.5
(58) Field of Search ..... 439/541.5, 620, 439/79, 63

(56) References Cited

U.S. PATENT DOCUMENTS 5,709,568 A * 1/1998 Pane et al. ..... 439/541.5
6,062,904 A * 5/2000 Oguchi et al. ..... 439/541.5
6,089,878 A * 7/2000 Meng ..... 439/79
6,179,653 B1 * 2/2001 Cheng et al. ..... 439/541.5
6,227,905 B1 * 5/2001 Tsai et al. ..... 439/541.5
6,234,834 B1 * 5/2001 Tsai et al. ..... 439/541.5
6,287,129 B1 * 9/2001 Kuo ..... 429/541.5

* cited by examiner

*Primary Examiner*—Gary Paumen
*Assistant Examiner*—Felix O. Figueroa
(74) *Attorney, Agent, or Firm*—Wei Te Chung

(57) ABSTRACT

An electrical connector (1) includes a first electrical connector subassembly (2), a second electrical connector subassembly (3), a dielectric holder (4), a special-purpose printed circuit board (5), an insulative retainer (6) and a conductive outer shield (7). The first and the second electrical connector subassemblies respectively have electrical terminals (22) and electrical contacts (32) electrically connecting with the printed circuit board. The dielectric holder retains the second electrical connector subassembly and is assembled to the first electrical connector subassembly and the conductive outer shield. The insulative retainer retains the printed circuit board and is latched with the first electrical connector subassembly, the dielectric holder and the conductive outer shield.

2 Claims, 12 Drawing Sheets

ELECTRICAL CONNECTOR HAVING PRINTED CIRCUIT BOARD MOUNTED THEREIN

BACKGROUND OF THE INVENTION

1. Field of the Invention

The present invention relates to an electrical connector, and particularly to an electrical connector having a printed circuit board mounted therein.

2. Description of the Related Art

Electrical contacts of electrical connectors are generally arranged in upper and lower rows and tail portions, through which the electrical contacts are mounted to a printed circuit board, of the upper row of electrical contacts need to extend vertically a longer distance than those of the lower row of electrical contacts. As a result, the electrical contacts in the upper and the lower rows must be separately manufactured, thereby complicating the manufacturing of the electrical contacts and the cost therefor.

A printed circuit board (so-called daughter board) performing a specialized function, for example a sound card, is electrically connected to another printed circuit board (so-called mother board) and connects with an electrical connector, for example an audio jack connector, through the mother board. In this way, the audio jack connector and the sound card respectively occupy 'real estate' on the mother board and unavoidably consume precious and limited space of the mother board.

Therefore, a solution to the above problems is desired.

SUMMARY OF THE INVENTION

A first object of the present invention is to provide an electrical connector having easily manufactured electrical contacts.

A second object of the present invention is to provide an electrical connector incorporating therein a printed circuit board performing a specialized function to save the space of a mother board.

An electrical connector in accordance with the present invention comprises a first electrical connector subassembly, a second electrical connector subassembly, a dielectric holder, a printed circuit board, an insulative retainer and a conductive outer shield. The first and the second electrical connector subassemblies respectively have electrical terminals and electrical contacts electrically connected with the printed circuit board. The dielectric holder holds the second electrical connector subassembly and is assembled to the first electrical connector subassembly and the conductive outer shield. The insulative retainer retains an upper end of the printed circuit board and is latched with the first electrical connector subassembly, the dielectric holder and the conductive outer shield.

Other objects, advantages and novel features of the invention will become more apparent from the following detailed description of the present embodiment when taken in conjunction with the accompanying drawings.

DETAILED DESCRIPTION OF THE INVENTION

Figure 1:
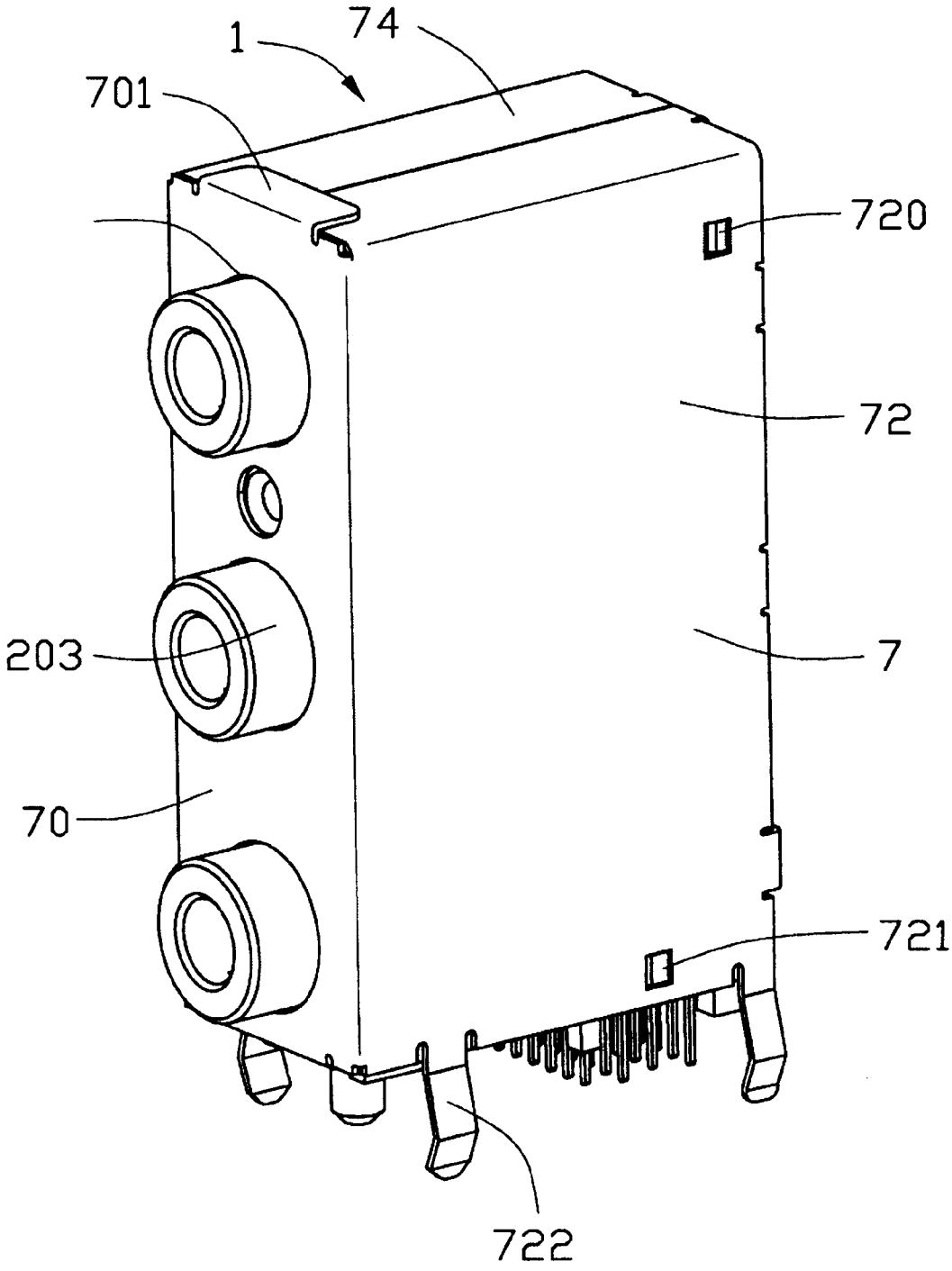
FIG. 1 is a perspective view of an electrical connector in accordance with the present invention.

Referring to FIGS. 1–4, an electrical connector 1 in accordance with the present invention comprises a first electrical connector subassembly 2, a second electrical connector subassembly 3, a dielectric holder 4, a printed circuit board 5, an insulative retainer 6 and a conductive outer shield 7.

Figure 5:
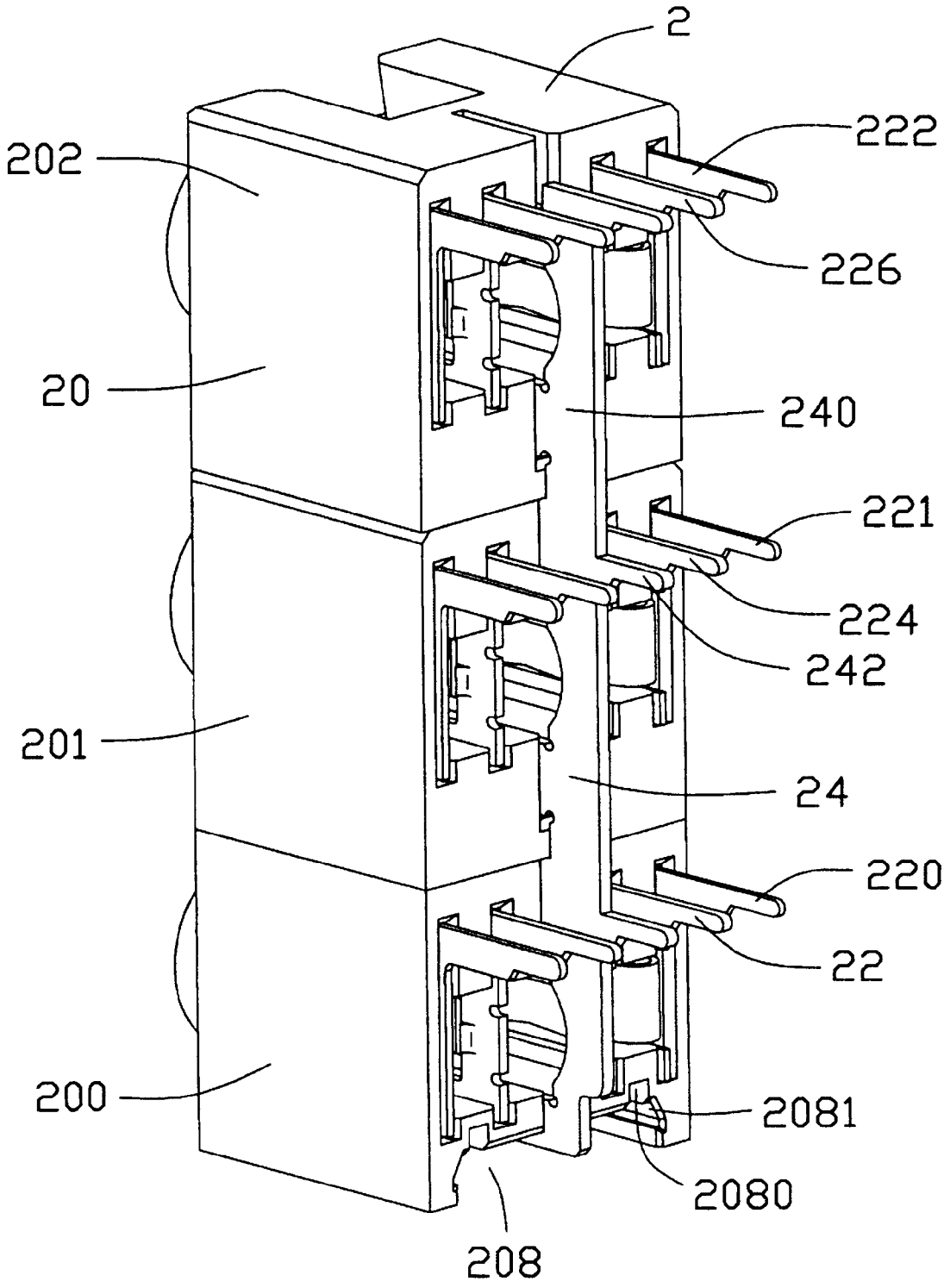
FIG. 5 is a perspective view of a first electrical connector subassembly of the electrical connector of FIG. 1.
Figure 6:
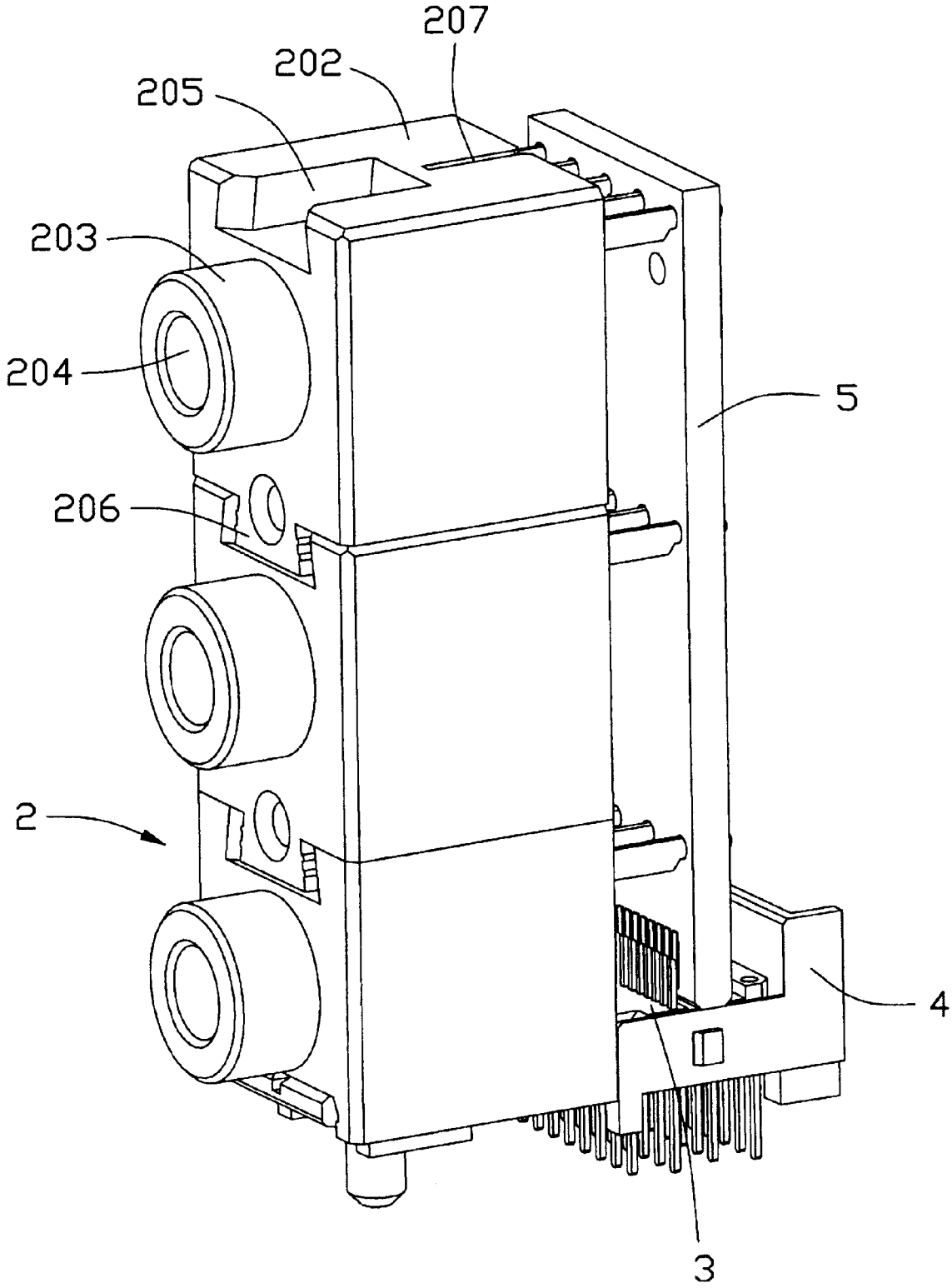
FIG. 6 is a view similar to FIG. 5 but taken from another perspective wherein the first electrical connector subassembly has been assembled to a second electrical connector subassembly, a dielectric holder and a printed circuit board.

Referring also to FIGS. 5 and 6, the first electrical connector subassembly 2 is a stacked audio jack connector and comprises a dielectric housing group 20 including a bottom, a middle and a top housings 200, 201, 202 arranged in a stacked relationship, a set of conductive terminal groups 22 which comprises a bottom, a middle and a top terminal rows 220, 221 and 222, and a one-piece grounding contact 24.

The middle and the top housings 201 and 202 have an identical structure, so only the top housing 202 will be detailed hereinafter. The top housing 202 is rectangular shaped and comprises a front cylindrical neck 203 which extends forward from a front face thereof and defines a through hole 204 for receiving a plug of a plug connector (not shown). A dove-tail recess 205 is defined in a front end of a top potion of the top housing 202. A dove-tail protrusion 206, corresponding to a dove-tail recess 205 on the middle housing 201, depends downwardly from a bottom surface of the top housing 202. A slit 207 is defined in a rear end of the top portion of the top housing 202. The bottom housing 200 has a structure similar to that of the housing 201 or 202 with the exception that the dove-tail protrusion is eliminated and in its place is an enlarged recess 208 defined in the bottom surface of the bottom housing 200 and a pair of top channels 2080 and a pair of side channels 2081 in communication with the enlarged recess 208.

The conductive terminal rows 220, 221 and 222 each comprise four longitudinal conductive terminals 224 parallel to one another. The conductive terminal rows 220, 221 and 222 have the same structure and each comprises a plug contact portion 225 received in a receiving cavity 209 of the housing 200, 201 or 202 in communication with the through hole 204, and a mounting portion 226 extending rearwardly and horizontally beyond the housing.

The one-piece grounding contact 24 comprises a vertical body strip 240, three arms 241 horizontally extending forward from the body strip 240 and three tails 242 horizontally extending rearward from the body strip 240. The arms 241 are spaced apart and parallel to one another for inserting into the receiving cavities 209 of the housings 200, 201 and 202 and between the four terminals 224 of each terminal row 220, 221 or 223. The tails 242 are also spaced apart and parallel to one another to be align in the terminal rows 220, 221 and 223 with and between the mounting portions 226 of the terminals 224. A pair of projections 243 extend forwardly from the body strip 240, one adjacent to the top and the other to the middle arms 241 respectively, for inserting in the slits 207 of the middle and the bottom housings 201, 200.

Figure 7:
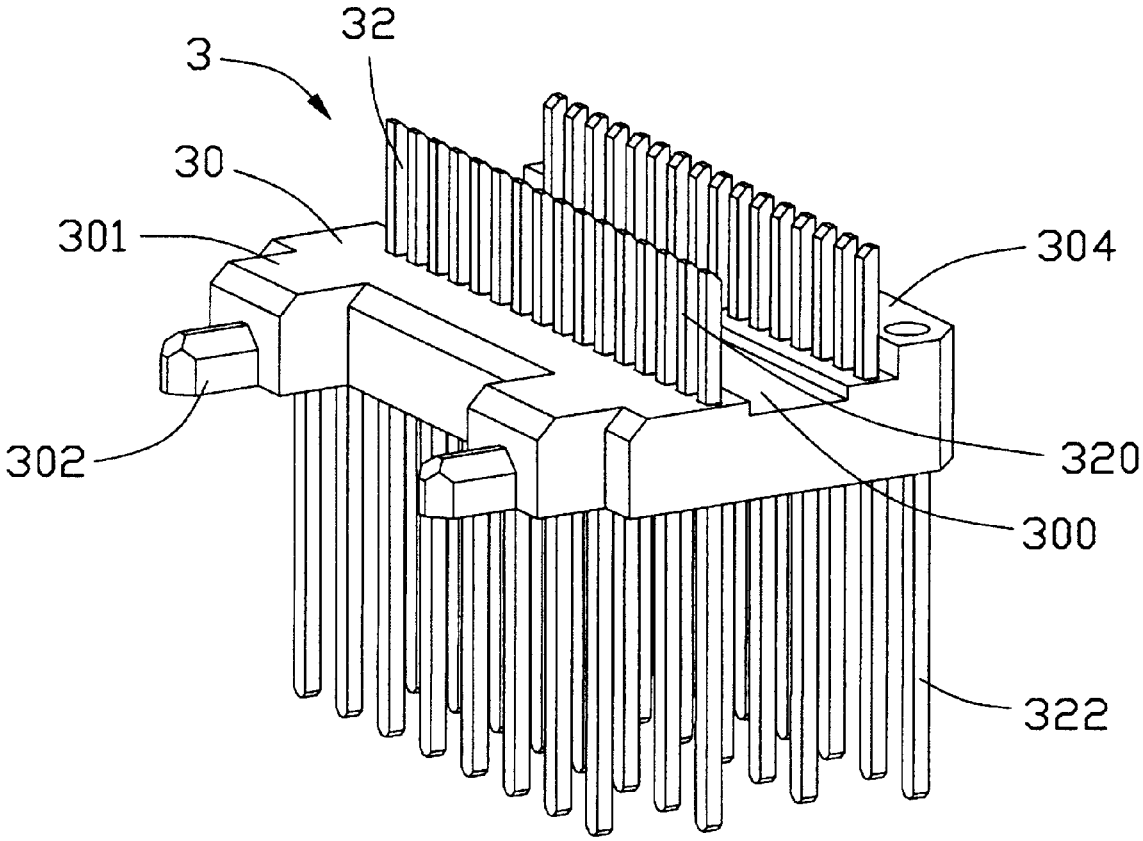
FIG. 7 is a perspective view of the second electrical connector subassembly of the electrical connector of FIG. 1.

Referring also to FIG. 7, the second electrical connector subassembly 3 comprises an insulative housing 30 and a plurality of electrical contacts 32. The insulative housing 30 has an intermediate portion 300, a pair of front blocks 302 extending forwardly from two opposite sides of the intermediate portion 300 and each having a finger 302 extending forwardly from a front and lower portion thereof; and a step portion 304 extending upwardly at a rear end of the intermediate portion 300.

The electrical contacts 32 are insert molded in the intermediate portion 300 of the insulative housing 30 and each has a printed circuit board contacting portion 320 protruding outwardly from one surface of the insulative housing 30 and a printed circuit board mounting portion 322 extending outwardly from another opposite surface of the insulative housing 30. The printed circuit board contacting portions 320 are arranged in two rows and the printed circuit board mounting portions 322 are arranged in four rows.

Figure 8:
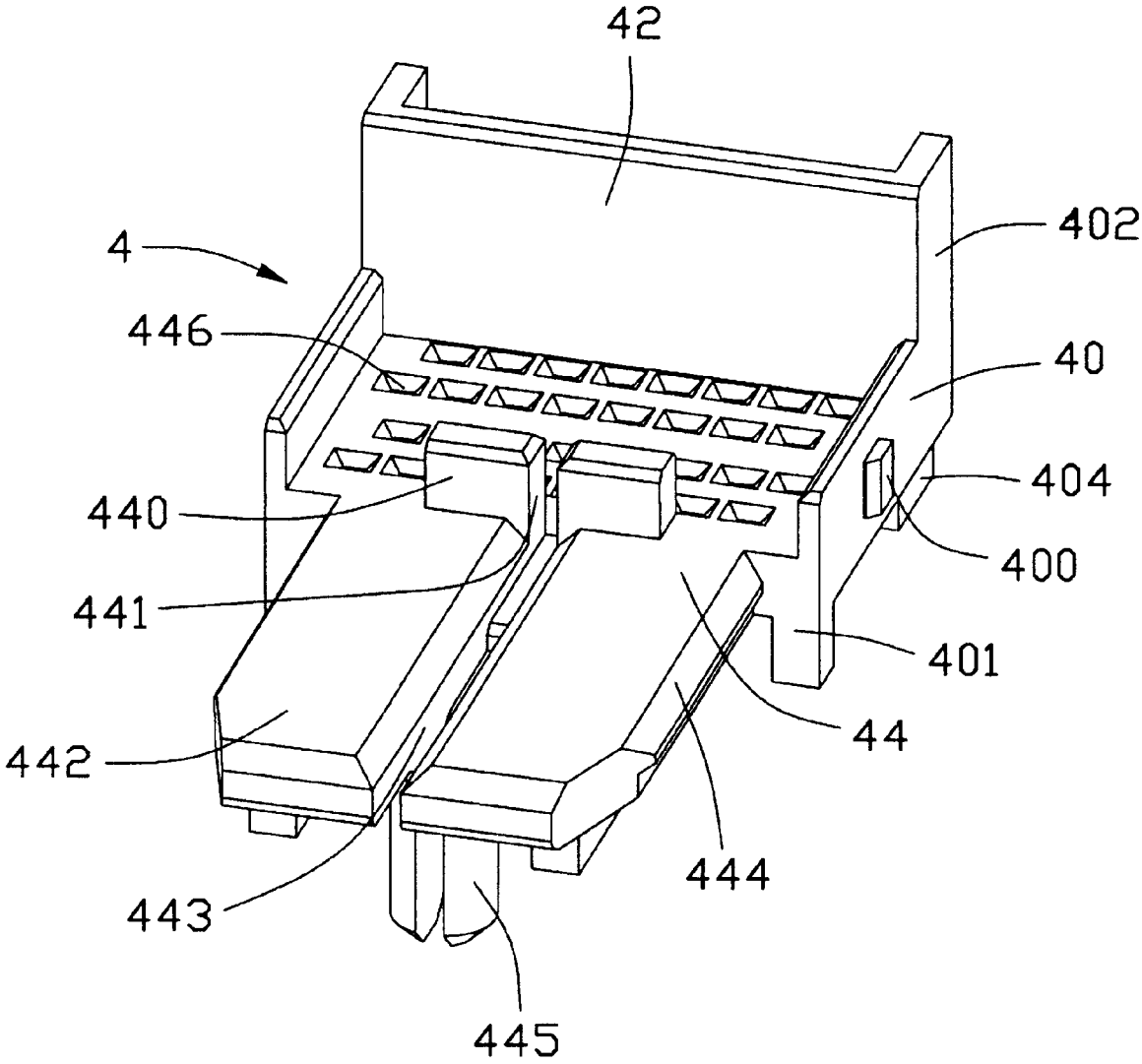
FIG. 8 is a perspective view of the dielectric holder.
Figure 9:
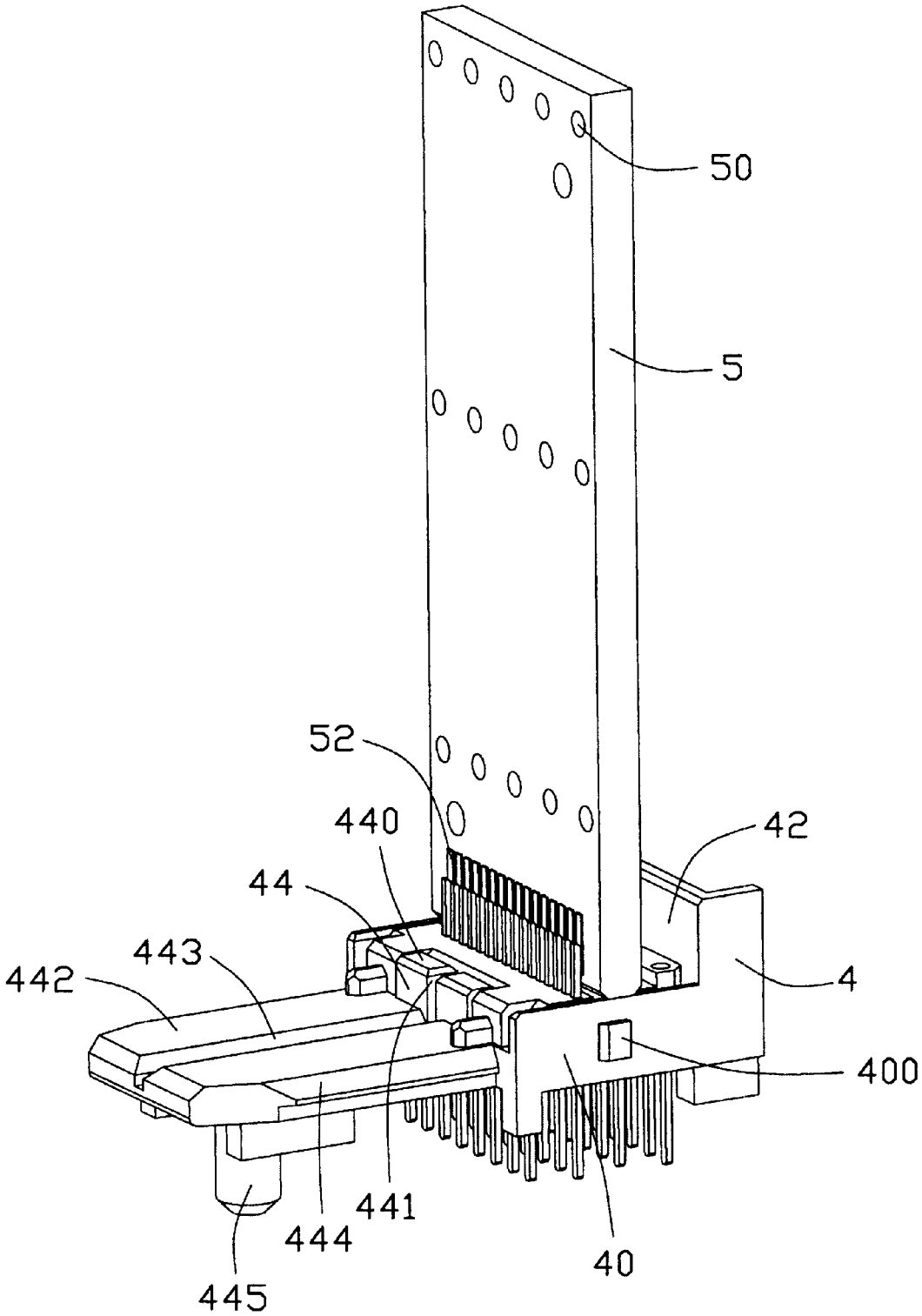
FIG. 9 is an assembled perspective view of the second electrical connector subassembly, the dielectric holder and the printed circuit board.
Figure 10:
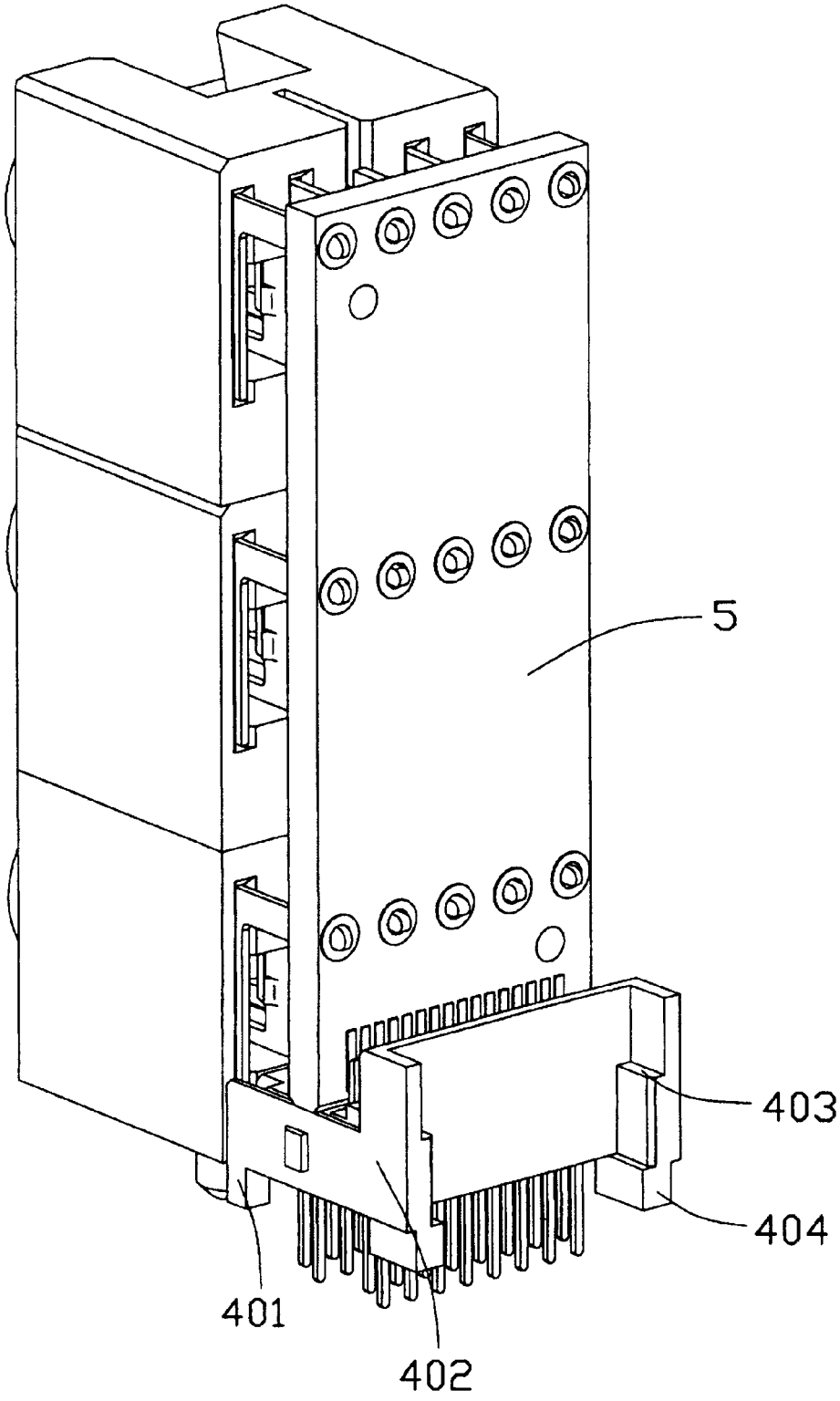
FIG. 10 is a view similar to FIG. 6 but taken from a different perspective.

Referring also to FIGS. 8 to 10, the dielectric holder 4 includes a pair of side walls 40, a rear wall 42 connecting rear ends of the side walls 40, a plate wall 44 extending between the rear wall 42 and the side walls 40. One of the side walls 40 has a barb 400 in an outer surface thereof. Each side wall 40 comprises a standoff 401 extending downwardly from a bottom face of a front portion thereof and a rear portion 402 extending rearwardly beyond the rear wall 42. The rear portions 402 are relatively higher than other portions of the side walls and flush with the rear wall 42 in the height thereof. Each rear portion 402 includes a step portion 403 in an inner surface thereof and a rear standoff 404 at a lower portion thereof. The plate wall 44 has a pair of blocks 440 protruding upwardly from a center portion thereof and separated by a block slit 441 therebetween, and a forward tongue 442 extending forwardly beyond the side walls 40 and the blocks 440. The forward tongue 46 corresponds in shape to the enlarged recess 208 of the bottom insulative housing 200 of the first electrical connector subassembly 2. The forward tongue 442 defines a forward slit 443 in a center portion thereof in communication with the block slit 441 and has a pair of side wings 444 (only one shown) extending at rear portions of opposite sides thereof and a generally cylindrical post 445 depending downwardly from a bottom surface of a center and front portion thereof. A rear portion of the plate wall 44 defines a plurality of through holes 446 extending vertically therethrough and corresponding in the number to the electrical contacts 32 of the second electrical connector subassembly 3.

The printed circuit board 5 is generally rectangular and defines three rows of solder holes 50 in an upper portion thereof and two rows of solder pads 52 at opposite side surfaces of a lower portion thereof. The solder holes 50 and the solder pads 52 could, as known to persons of ordinary skill in the pertinent art, also be solder pads and solder holes, respectively, if desired.

Figure 11:
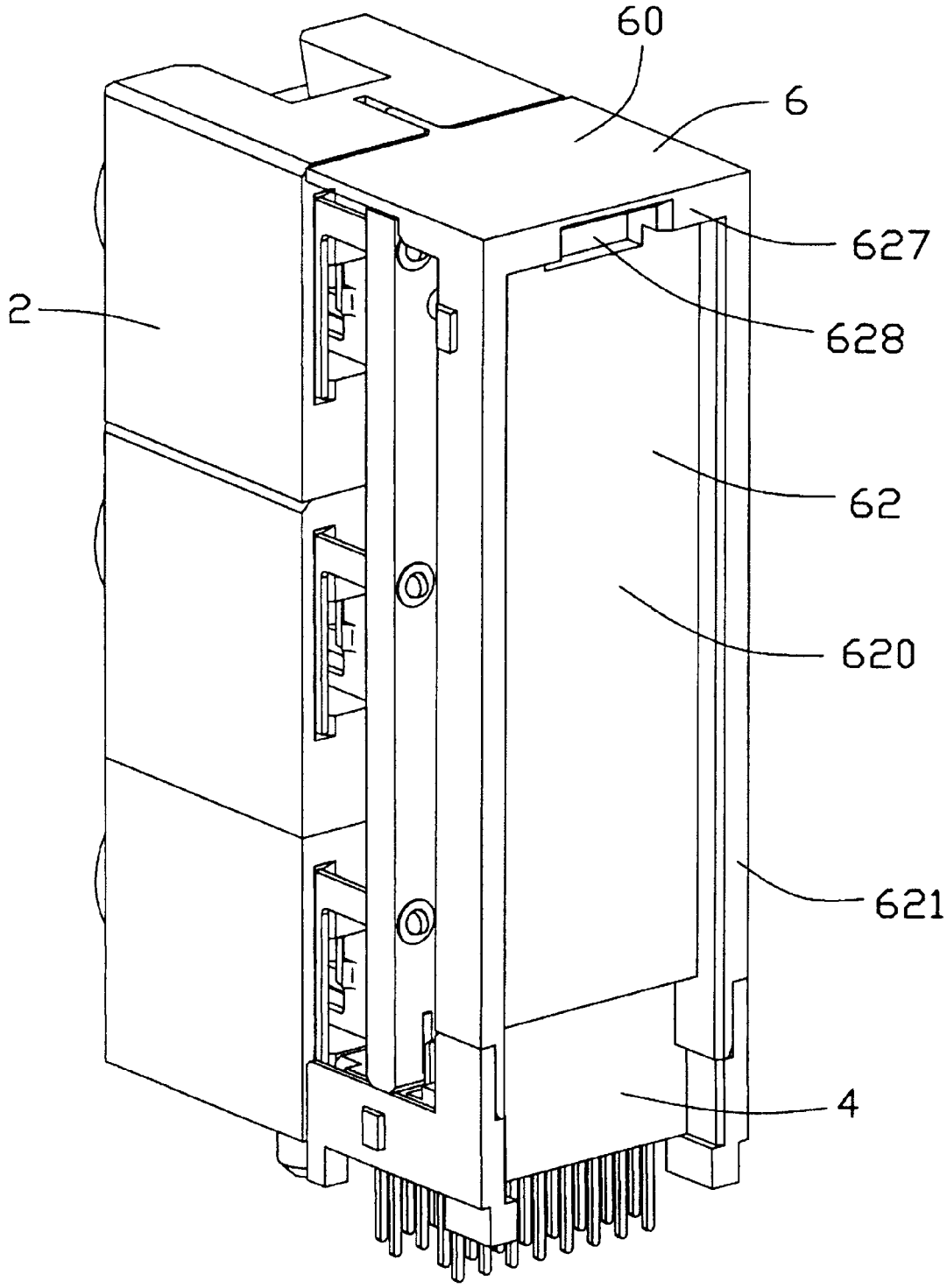
FIG. 11 is a view similar to FIG. 9 but an insulative retainer has been added thereto.
Figure 12:
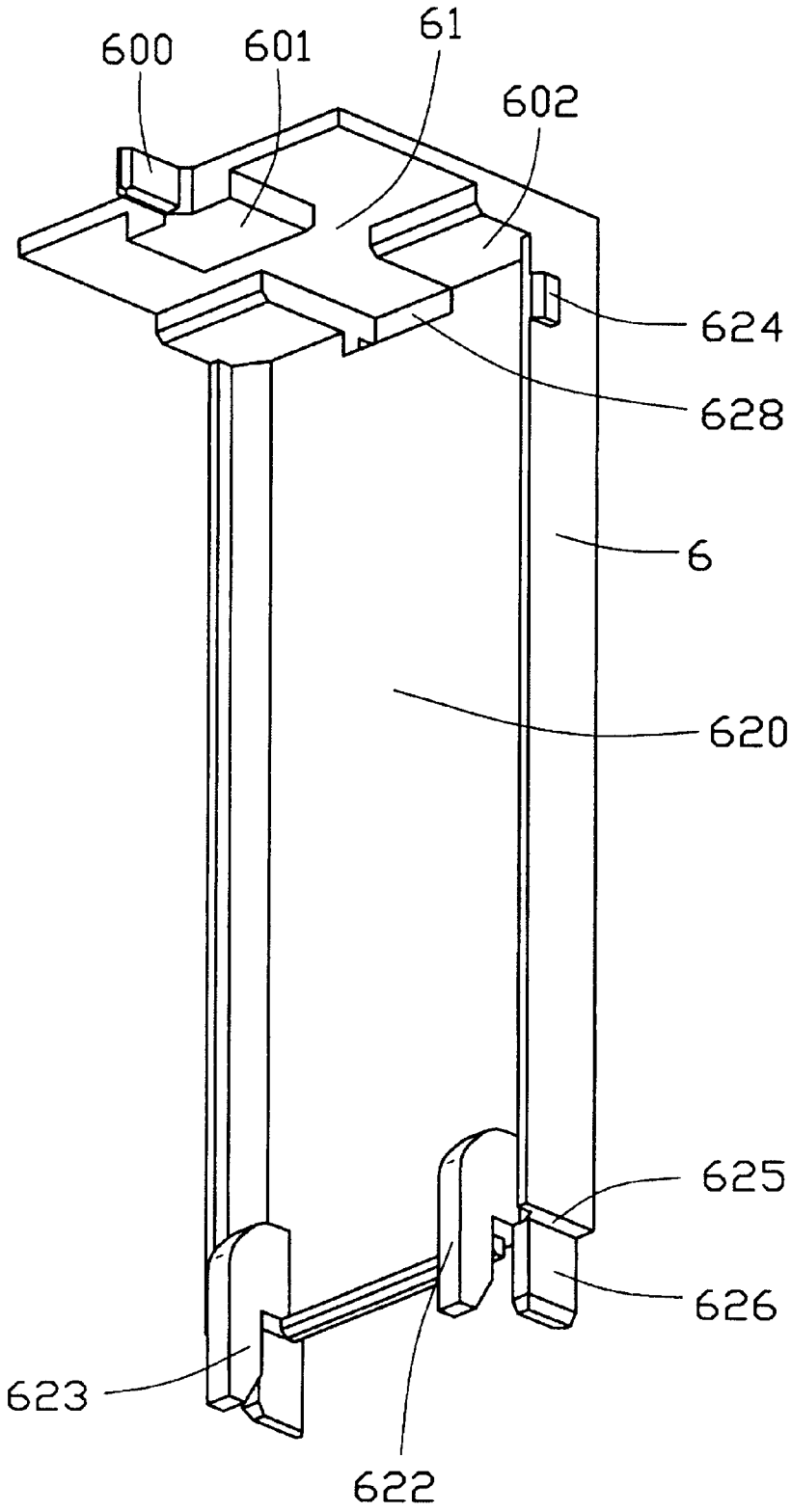
FIG. 12 is a perspective of the insulative retainer.

Referring also to FIGS. 11 and 12, the insulative retainer 6 comprises a horizontal portion 60 and a vertical portion 62 extending perpendicularly from a rear end of the horizontal portion 60. The horizontal portion 60 is formed with a retention rib 600 extending forwardly from a front center section thereof, a front platform 601 extending downwardly from a front and center section of a bottom surface thereof and a pair of opposite rear platforms 602 extending downwardly from a rear portion of the bottom surface thereof. The front and the rear platforms 601, 602 define a channel 61 therebetween. The vertical portion 62 comprises a plate section 620, a pair of tabs 622 extending inwardly and downwardly from an inner surface of the plate section 620, a top beam 627 protruding from a top portion of the plate section 620 and a pair of side beams 621 protruding from opposite sides of the plate section 620. Each tab 622 has a head section 623 extending downwardly beyond a lower end of the plate section 620 and having an inclined guiding face. Each side beam 621 has a protrusion 624 at an outer surface of an upper portion thereof, a step portion 625 adjacent to a lower portion thereof and a retaining tab 626 extending downwardly beyond the tabs 622 and the plate section 620. An aperture 628 is defined in an upper portion of the plate section 620 starting from the top beam 627.

Figure 2:
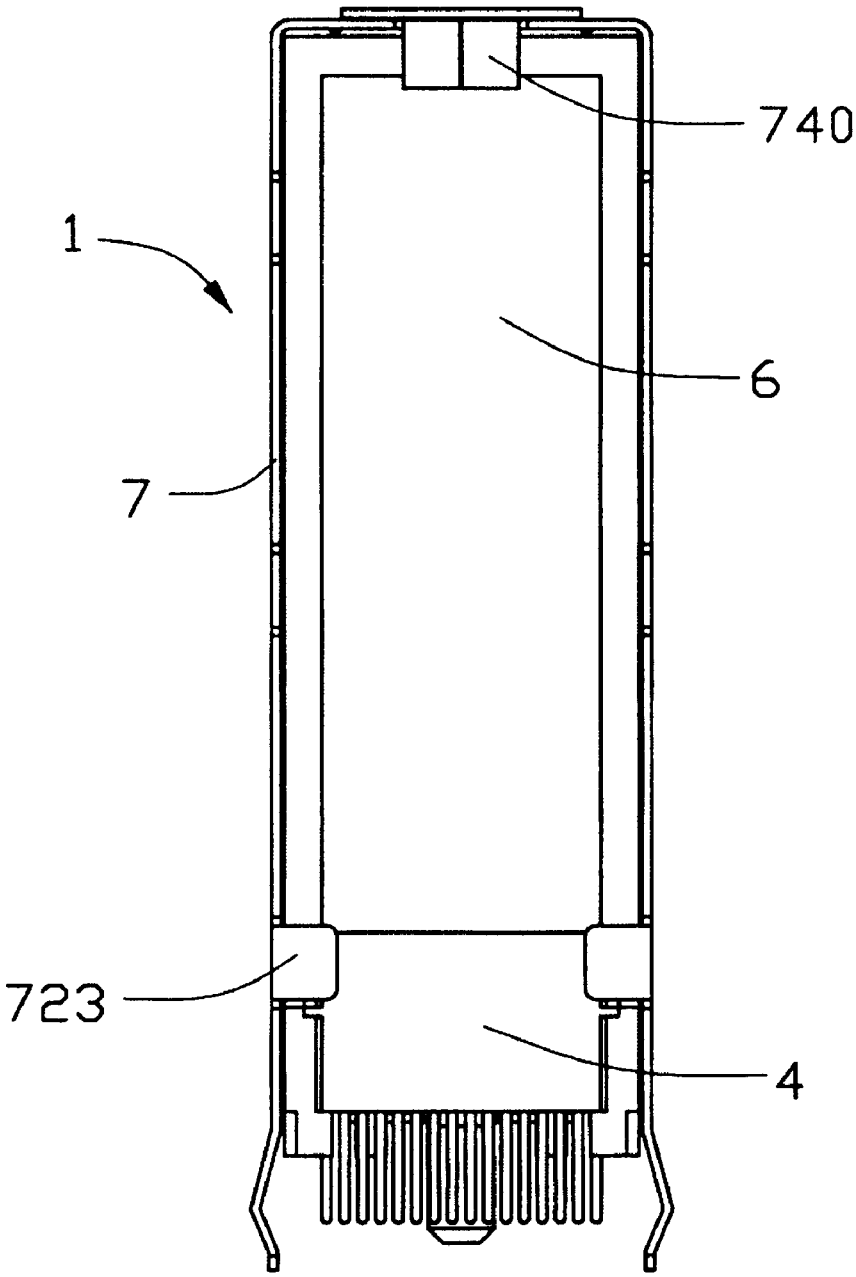
FIG. 2 is a rear plan view of the electrical connector of FIG. 1.
Figure 3:
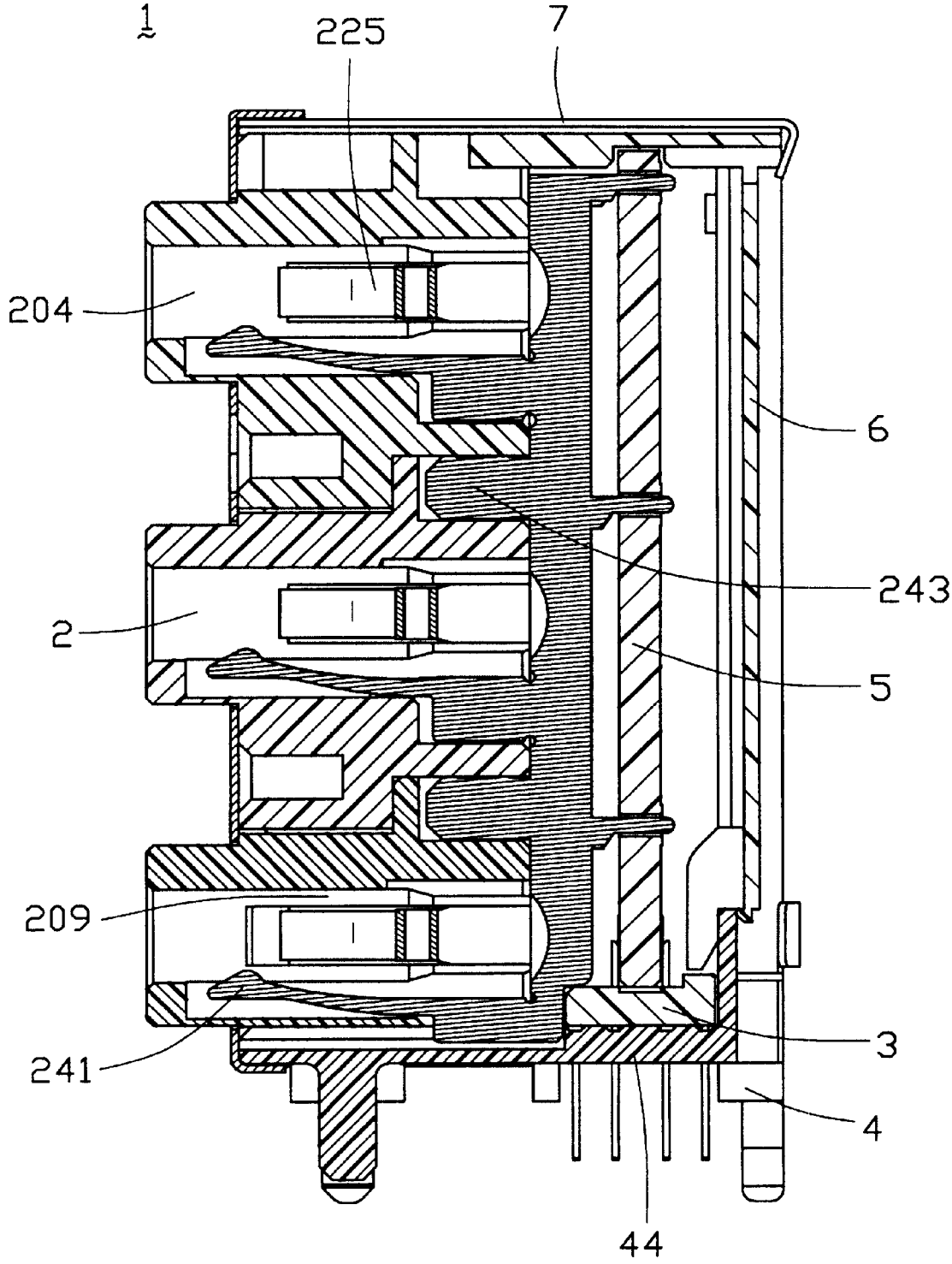
FIG. 3 is a cross sectional view of the electrical connector of FIG. 1.
Figure 4:
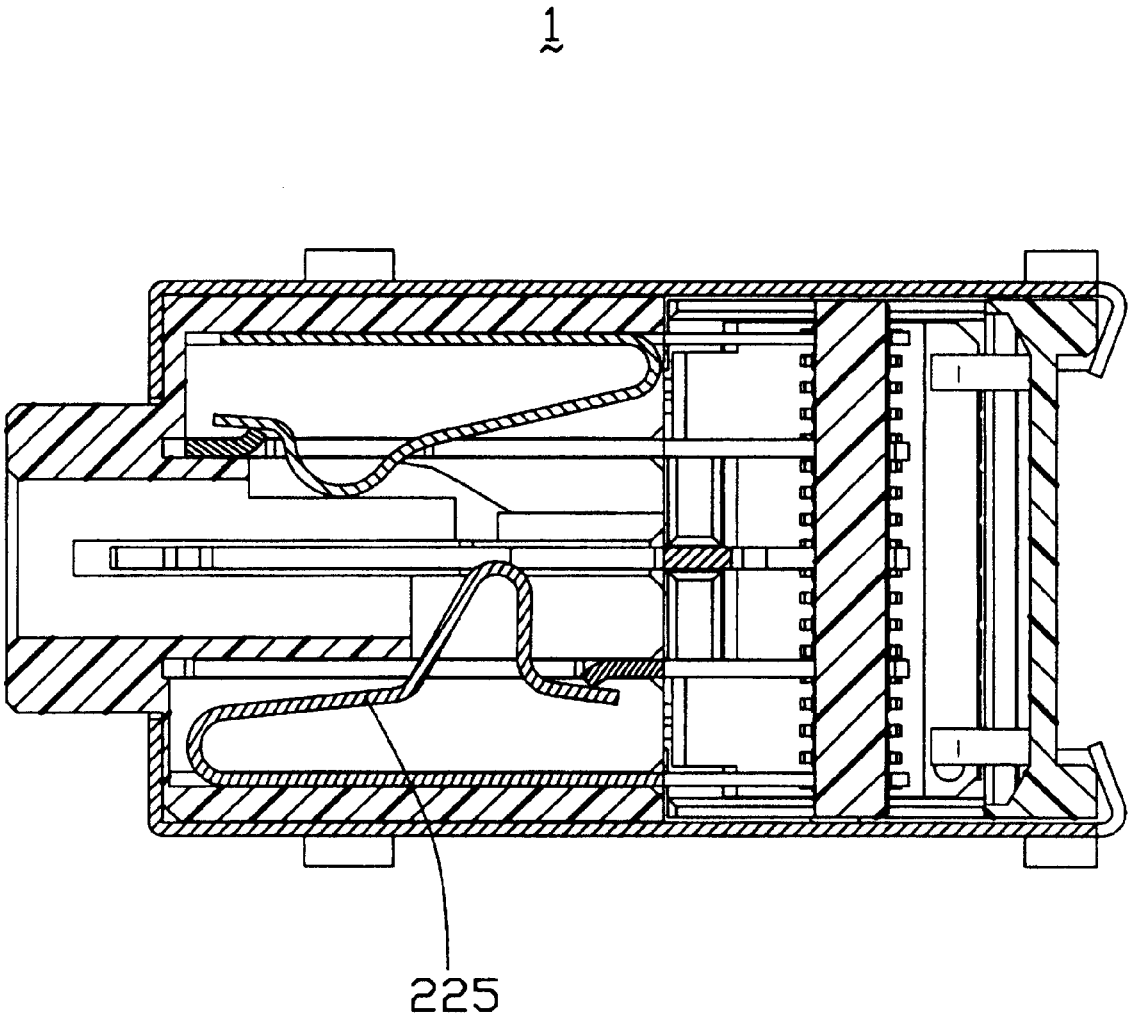
FIG. 4 is another cross sectional view of the electrical connector of FIG. 1.

Referring also to FIGS. 1 and 2, the conductive outer shield 7 is rectangular shaped and comprises a front wall 70, a pair of side walls 72 and a top wall 74. The front wall 70 defines three openings 700 corresponding to the cylindrical necks 203 of the housings 200, 201, 202 and has a front flange 701 extending perpendicularly from a top end thereof. Each side wall 72 includes a window 720 in an upper and rear portion thereof, a hole 721 adjacent to a rear and lower portion thereof, a pair of grounding tabs 722 extending downwardly from a lower end thereof and a side flange 723 extending perpendicularly from a lower and rear end thereof. The top wall 74 comprises two parts extending respectively perpendicular from top ends of the side walls 72 and has a top flange 740 extending perpendicularly from a rear end thereof.

In assembly, the two rows of printed circuit board contacting portions 320 of the electrical contacts 32 of the second electrical connector subassembly 3 are electrically soldered to the solder pads 52 of the printed circuit board 5. The second electrical connector subassembly 3 with the printed circuit board 5 is assembled with the dielectric holder 4 with the step portion 304 abutting against the rear wall 42 and the printed circuit mounting portions 322 extending through the plate wall 44. The blocks 440 press fit between and align with the front blocks 301 of the insulative housing 30 of the second electrical connector subassembly 3 and the fingers 302 rest on an upper surface of a rear end of the forward tongue 442.

The forward tongue 442 is then inserted into the enlarged recess 208 of the bottom housing 200 of the first electrical connector subassembly 2 and the side wings 444 engage with the side channels 2081. The fingers 302 engage with the top channels 2080, respectively. A lower end of the one-piece grounding contact 24 is received in the block slit 441 and the forward slit 443 of the dielectric holder 4. The mounting portions 226 of the terminals 22 and the tails 242 of the one-piece grounding contact 24 of the first electrical connector subassembly 2 soldered to the solder holes 50 of the printed circuit board 5.

The retention rib 600 of the insulative retainer 6 extends into the slit 207 of the top housing 202 of the first electrical connector subassembly 2. The channel 61 of the insulative retainer 6 receives and retains a top end of the printed circuit board 5. The step portions 625 of the side beams 621 engage with the rear wall 42 of the dielectric holder 4 while the head sections 623 of the tabs 622 abut against an inner face of the rear wall 42 and the retaining tabs 626 engage with the step portions 403 of the rear portions 402 of the side walls 40 of the holder 4.

The conductive outer shield 7 is then assembled to enclose the first and the second electrical connector subassemblies 2, 3, the dielectric holder 4, the printed circuit board 5 and the insulative retainer 6. The necks 203 of the housings 200, 201, 202 protrude through the openings 700 of the front wall 70. The front flange 701 overlaps and presses front ends of the two parts of the top wall 74. The windows 720 receivably engage with protrusions 624 of the insulative retainer 6 while the holes 721 mate with the barbs 400 of the dielectric holder 4. The top flange 740 of the top wall 74 and the side flanges 723 of the side walls 72 latch with the aperture 628 of the top beam 627 and the retaining tabs 626, respectively. Thus, the electrical connector I is securely assembled.

The electrical terminal rows 220, 221, 222 all have identical structures and need not be separately manufactured, thereby the manufacturing of the terminals 224 is relatively simple. The printed circuit board 5, which is dimensioned vertically large/long enough to provide sufficient space thereof for mounting a plurality of electronic components (not shown) thereon, is capable of performing functions as ordinary sound card which is originally an add-on card located outside of the audio jack connector and connected to the mother board via an additional edge card connector. Thus, in the invention the electrical connector 1 incorporating both the first electrical connector subassembly 2, (i.e., the stacked audio jack connector) and the printed circuit board 5 therein performs an integrated function of the conventional audio jack connectors and sound cards and thus saves the precious space on a so-called mother board to which the conventional audio jack connectors and the sound cards are originally designedly respectively mounted and to which the unitary electrical connector 1 of the invention is now solely mounted instead.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector device comprising:

a first connector subassembly including an insulative housing defining at least three ports stacked one another;

each of said three ports including a plurality of terminals each with a rearwardly extending board-mounting portion;

a grounding contact positioned behind the first housing with three arms forwardly extending respectively into the corresponding port and at least one rearwardly extending tails;

a printed circuit board vertically disposed behind the three ports and perpendicular to said grounding contact, said board-mounting portion of each of said terminals and said tail being mechanically and electrically connected to said printed circuit board; and a second connector subassembly positioned under the printed circuit board with a plurality of contacts mechanically and electrically connected to a lower edge of the printed circuit board; wherein said printed circuit board is dimensioned to be substantially long enough to vertically extend along all three ports to provide sufficient space thereof for mounting thereon a plurality of electronic components performing a sound card;

wherein a holder is provided on a rear portion of the device to hold the second subassembly and the first subassembly together;

wherein said grounding contact is a unitary piece with an elongated strip vertically extending all three ports;

wherein said strip defines a plane perpendicular to said printed circuit board.

2. An electrical connector for mounting to a mother board, comprising:

a first connector subassembly comprising an insulative housing comprising a cylindrical neck protruding forwardly and a plurality of electrical terminals accommodated in the insulative housing, each electrical terminal comprising a mounting portion extending rearwardly with respect to the cylindrical neck beyond the insulative housing;

a printed circuit board being electrically connected with the mounting portions of the electrical terminals; and a second electrical connector subassembly assembled to the first electrical connector subassembly and comprising a plurality of electrical contacts each comprising a printed circuit board contacting portion electrically connected with the printed circuit board and a printed circuit board mounting portion adapted for mounting to a mother board;

wherein the insulative housing of the first electrical connector subassembly comprises a bottom, a middle and a top housings stacked with each other, and the electrical terminals of the first electrical connector subassembly comprise a bottom, a middle and a top terminal rows respectively received in the bottom, the middle and the top housings and electrically connected with the printed circuit board;

wherein the bottom and the middle housings each comprise a dove-tall recess in an upper portion thereof and the middle and the top housings each comprise a dove-tail protrusion respectively engaging with the dove-tail recesses of the bottom and the middle housings;

wherein the bottom housing of the first electrical connector subassembly defines an enlarged recess in a bottom thereof, a pair of top channels and a pair of side channels in communication with the enlarged recess and wherein the second electrical connector subassembly comprises an insulative housing comprising a pair of fingers engaged with the top channels;

a dielectric holder accommodating the insulative housing of the second electrical connector subassembly and receiving the printed circuit board mounting portions of the electrical contacts of the second electrical connector subassembly to extend therethrough, the dielectric holder comprising a forward tongue extending into the enlarged recess; wherein the forward tongue comprises a pair of side wings extending into the side channels of the bottom housing and a forward slit, the first electrical connector subassembly comprising a one-piece grounding contact having a lower portion received in the forward slit;

an insulative retainer comprising a vertical portion comprising a pair of first tabs, a pair of first step portions and a pair of second tabs, wherein the holder comprises a rear wall engaging with the first tabs and the first step portions and a pair of second step portions retaining the second tabs;

wherein the retainer comprises a horizontal portion extending perpendicularly from the vertical portion and defining a channel for receiving an upper end of the printed circuit board;

a conductive outer shield defining three openings, and wherein each of the bottom, the middle and the top housings comprises a cylindrical neck extending through the openings of the conductive outer shield;

wherein the conductive outer shield defines a pair of windows in opposite side walls thereof and the vertical portion of the insulative retainer comprises a pair of protrusions corresponding to the windows;

wherein the conductive outer shield defines a pair of holes in opposite side walls thereof and the dielectric holder comprises a pair of barbs corresponding to the holes.

* * * * *